US008596994B2

(12) United States Patent
Taguchi

(10) Patent No.: US 8,596,994 B2
(45) Date of Patent: Dec. 3, 2013

(54) COMPRESSOR

(75) Inventor: Yukihiko Taguchi, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 979 days.

(21) Appl. No.: 12/088,776

(22) PCT Filed: Oct. 3, 2006

(86) PCT No.: PCT/JP2006/319747
§ 371 (c)(1),
(2), (4) Date: Mar. 31, 2008

(87) PCT Pub. No.: WO2007/049430
PCT Pub. Date: May 3, 2007

(65) Prior Publication Data

US 2009/0136366 A1 May 28, 2009

(30) Foreign Application Priority Data

Oct. 28, 2005 (JP) ..... 2005-313767

(51) Int. Cl.
*F04B 53/00* (2006.01)

(52) U.S. Cl.
USPC ..... 417/312; 417/222.2; 417/269; 137/512.1; 137/514.5; 137/543.19

(58) Field of Classification Search
USPC ..... 417/269, 222.1, 222.2, 312, 540; 137/535, 539, 540, 512.1, 543.19, 137/514.5; 251/205
See application file for complete search history.

(56) References Cited

U.S. PATENT DOCUMENTS

| | | | | | |
|---|---|---|---|---|---|
| 2,318,962 | A | * | 5/1943 | Parker | 137/514.5 |
| 3,092,133 | A | * | 6/1963 | Clark | 137/220 |
| 3,765,447 | A | * | 10/1973 | Cornell | 137/538 |
| 4,051,864 | A | * | 10/1977 | Iwatsuki | 137/504 |
| 4,403,921 | A | | 9/1983 | Kato et al. | |
| 4,862,913 | A | * | 9/1989 | Wildfang | 137/543 |

(Continued)

FOREIGN PATENT DOCUMENTS

| | | | |
|---|---|---|---|
| EP | 0478378 | A2 | 4/1992 |
| EP | 0743456 | A2 | 11/1996 |

(Continued)

OTHER PUBLICATIONS

European Patent Office, Extended European Search Report for International Patent Appl'n No. PCT/JP2006319747, dated Sep. 10, 2008. (Counterpart of above-captioned U.S. patent application).

(Continued)

*Primary Examiner* — Devon Kramer
*Assistant Examiner* — Joseph Herrmann
(74) *Attorney, Agent, or Firm* — Baker Botts L.L.P.

(57) ABSTRACT

A compressor includes a compressing mechanism, a discharge chamber, a housing accommodating the compressing mechanism and the discharge chamber, a discharge port communicating with the discharge chamber through a discharge passage and also with an external refrigerant circuit, a muffler formed by an expanded space disposed on the discharge passage, and a check valve disposed on the discharge passage. The pressure loss caused by the discharge passage is less than that in the known compressor. The check valve is disposed in the muffler to open and close an inlet of the muffler, and the muffler is formed by the housing and a cover independent of and connected to the housing.

10 Claims, 4 Drawing Sheets

(56) References Cited

U.S. PATENT DOCUMENTS

| | | | | |
|---|---|---|---|---|
| 4,874,066 | A * | 10/1989 | Silberstein | 188/280 |
| 5,112,198 | A * | 5/1992 | Skinner | 417/269 |
| 5,208,429 | A | 5/1993 | Field | |
| 5,533,871 | A | 7/1996 | Takenaka et al. | |
| 5,583,325 | A * | 12/1996 | Schutte et al. | 181/237 |
| 5,823,294 | A * | 10/1998 | Mizutani et al. | 184/6.3 |
| 5,871,337 | A | 2/1999 | Fukanuma et al. | |
| 6,203,284 | B1 | 3/2001 | Kawaguchi et al. | |
| 6,227,812 | B1 * | 5/2001 | Kawaguchi et al. | 417/222.2 |
| 6,250,891 | B1 * | 6/2001 | Kawaguchi et al. | 417/222.2 |
| 6,435,848 | B1 * | 8/2002 | Minami et al. | 417/440 |
| 6,511,297 | B2 * | 1/2003 | Ota et al. | 417/222.2 |
| 6,520,751 | B2 * | 2/2003 | Fujita et al. | 417/295 |
| 6,626,645 | B2 * | 9/2003 | Okii et al. | 417/222.2 |
| 6,648,010 | B1 * | 11/2003 | Goodwin | 137/493.1 |
| 6,848,262 | B2 * | 2/2005 | Nosaka | 62/115 |
| 6,905,318 | B2 * | 6/2005 | Kouno et al. | 417/559 |
| 7,581,560 | B2 * | 9/2009 | Koch et al. | 137/543.19 |
| 7,841,839 | B2 * | 11/2010 | Inoue et al. | 417/222.2 |
| 2002/0006339 | A1 | 1/2002 | Ota et al. | |
| 2004/0062660 | A1 * | 4/2004 | Kazahaya et al. | 417/222.1 |
| 2004/0184924 | A1 * | 9/2004 | Hayashi et al. | 417/222.1 |

FOREIGN PATENT DOCUMENTS

| | | | |
|---|---|---|---|
| JP | H07-189896 | A | 7/1995 |
| JP | H10-205446 | A | 8/1998 |
| JP | 2000-346241 | A | 12/2000 |
| JP | 2002-031050 | A | 1/2002 |

OTHER PUBLICATIONS

Japanese Patent Office, International Search Report for International Patent Application No. PCT/JP2006/319747, mailed Dec. 12, 2006.

* cited by examiner

COMPRESSOR

CROSS-REFERENCE TO RELATED APPLICATION

This application is the National Stage of International Patent Application No. PCT/JP2006/319747, filed Oct. 3, 2006, which claims the benefit of Japanese Patent Application No. 2005-313767, filed Oct. 28, 2005, the disclosures of which are incorporated herein by reference.

TECHNICAL FIELD

The present invention relates to a compressor provided with a check valve.

BACKGROUND ART

Patent document 1 teaches a compressor comprising a compressing mechanism, a discharge chamber, a housing accommodating the compressing mechanism and the discharge chamber, a discharge port communicating with the discharge chamber through a discharge passage and also with an external refrigerant circuit, a muffler formed by an expanded space disposed on the discharge passage, and a check valve disposed on the discharge passage, wherein the check valve is disposed in an accommodation chamber formed in the housing and adjacent to the discharge chamber.

In the aforementioned compressor, the check valve prevents back flow of high-pressure refrigerant gas from the external refrigerant circuit to the compressor during the stop period of the compressor.

Patent document 1: Japanese Patent Laid-Open Publication No. 11-315785

DISCLOSURE OF INVENTION

Problem to be Solved

A drawback of the aforementioned compressor is that the discharge passage causes a large pressure loss because of the large length of the portion of the discharge passage extending from the discharge chamber through the accommodation chamber for accommodating the check valve to the muffler and narrow space between the check valve and the surrounding wall of the small accommodation chamber for accommodating the check valve.

An object of the present invention is to provide a compressor comprising a compressing mechanism, a discharge chamber, a housing accommodating the compressing mechanism and the discharge chamber, a discharge port communicating with the discharge chamber through a discharge passage and also with an external refrigerant circuit, a muffler formed by an expanded space disposed on the discharge passage, and a check valve disposed on the discharge passage, wherein the pressure loss caused by the discharge passage is smaller than that in the conventional compressor.

Means for Solving the Problem

In accordance with the present invention, there is provided a compressor comprising a compressing mechanism, a discharge chamber, a housing accommodating the compressing mechanism and the discharge chamber, a discharge port communicating with the discharge chamber through a discharge passage and an external refrigerant circuit, a muffler formed by an expanded space disposed on the discharge passage, and a check valve disposed on the discharge passage, wherein the check valve is disposed in the muffler to open and close an inlet of the muffler, and the muffler is formed by the housing and a cover independent of and connected to the housing.

In the compressor of the present invention, the check valve is disposed in the muffler so as to extend the discharge passage extending between the discharge chamber and the discharge port from the discharge chamber directly to the muffler at the portion extending between the discharge chamber and the muffler. Therefore, the length of the discharge passage becomes shorter than that in the conventional compressor wherein an accommodation chamber for accommodating the check valve is disposed on the portion of the discharge passage extending between the discharge chamber and the muffler. The space between the check valve and the surrounding wall of the muffler in the compressor of the present invention is larger than the space between the check valve and the surrounding wall of the accommodation space in the conventional compressor because the muffler is an expanded space. As a result, pressure loss caused by the discharge passage in the compressor of the present invention is smaller than that in the conventional compressor.

The check valve can be mounted on the inlet of the muffler before the cover is mounted on the housing because the housing and the cover cooperate to form the muffler. As a result, the work of mounting the check valve becomes easy.

In a preferred embodiment of the present invention, the cover and the housing cooperate to clamp the check valve to fix it to the housing.

When the cover and the housing cooperate to clamp the check valve to fix it to the housing, the connection structure between the check valve and the housing becomes simpler than that formed by a snap ring, press fitting, etc.

In another preferred embodiment of the present invention, the check valve comprises a valve body, a valve seat forming member provided with an inlet hole and a valve seat surrounding the inlet hole and for abutting the valve body, a spring for forcing the valve body in the direction for closing the check valve, and an accommodation member having a cylindrical form closed at one end and fixed to the valve seat forming member to accommodate the valve body and the spring, wherein the accommodation member is provided with outlet holes directed at right angles to the inlet hole and capable of being closed by the valve body at the circumferential side wall, the inlet hole opposes the muffler side end of the portion of the discharge passage extending between the discharge chamber and the muffler, and the outlet holes oppose the muffler.

When the outlet holes of the check valve oppose the muffler, i.e., an expanded space, instead of the conventional small accommodation chamber, pressure loss caused by the discharge passage decreases.

In another preferred embodiment of the present invention, the accommodation member is provided with a small hole at the bottom wall.

It is possible to restrict the flow rate of refrigerant gas entering into or discharging from the space formed between the valve body and the bottom wall of the accommodation member through the small hole to a very low level, thereby forming a damper for preventing self-excited vibration of the valve body and pulsation of discharge pressure caused by the self-excited vibration of the valve body.

In another preferred embodiment of the present invention, the displacement of the compressor is variable, and each of the outlet holes of the check valve has a form of a combination of a triangular portion convex toward the valve seat with one apex directed to the valve seat and a rectangular portion with one side coinciding with the base of the triangular portion.

When a variable displacement compressor is run at a small displacement, the valve body lifts a little when the check valve opens because the pressure acting on the front surface of the valve body differs only a little from the pressure acting on the rear surface of the valve body. If the outlet holes have rectangular form, the opening area of the outlet holes becomes fairly large when the check valve opens even though the lift of the valve body is small. Thus, refrigerant gas discharges form the outlet holes at a fairly large flow rate to rapidly decrease the difference between the pressure acting on the front surface of the valve body and the rear surface of the valve body, thereby rapidly closing the check valve. When the check valve closes, the difference between the pressure acting on the front surface of the valve body and the rear surface of the valve body rapidly increases to rapidly open the check valve. As a result, the check valve repeatedly opens and closes when the variable displacement compressor is run at small displacement to cause self-excited vibration of the valve body, thereby generating pulsation of discharge pressure due to the self-exciting vibration of the valve body. When each of the outlet holes has the form of a combination of a triangular portion convex toward the valve seat with one apex directed to the valve seat and a rectangular portion with one side coinciding with the base of the triangular portion, the opened portion of the outlet hole becomes triangular and the opening area of the outlet holes does not become large when the lift of the valve body is small. Therefore, the flow rate of the refrigerant gas discharging from the outlet holes does not become large. As a result, self-exciting vibration of the valve body is prevented and the generation of the pulsation of the discharge pressure due to the self-exciting vibration of the valve body is prevented when the variable displacement compressor is run at small displacement.

In another preferred embodiment of the present invention, the compressing mechanism is a variable displacement swash plate compressing mechanism or a variable displacement wobble plate compressing mechanism, and the driving shaft of the compressing mechanism is connected to an external power source not through a clutch but directly.

When the compressing mechanism is a variable displacement swash plate compressing mechanism or a variable displacement wobble plate compressing mechanism, and the driving shaft of the compressing mechanism is connected to an external power source not through a clutch but directly, the compressor is run at the smallest displacement even if the circulation of refrigerant gas in the external refrigerant circuit is not necessary. Therefore, the check valve is indispensably installed to prevent circulation of refrigerant gas in the external refrigerant circuit when the compressor is run at the smallest displacement. When the check valve is disposed in the muffler, the length of the discharge passage becomes shorter than that in the conventional compressor, and pressure loss of the discharge passage becomes smaller than that in the conventional compressor.

Effect of the Invention

In the compressor of the present invention, the check valve is disposed in the muffler so as to extend the discharge passage extending between the discharge chamber and the discharge port from the discharge chamber directly to the muffler at the portion extending between the discharge chamber and the muffler. Therefore, the length of the discharge passage becomes shorter than that in the conventional compressor wherein an accommodation chamber for accommodating the check valve is disposed on the portion of the discharge passage extending between the discharge chamber and the muffler. The space between the check valve and the surrounding wall of the muffler in the compressor of the present invention is larger than the space between the check valve and the surrounding wall of the accommodation space in the conventional compressor because the muffler is an expanded space. As a result, pressure loss caused by the discharge passage in the compressor of the present invention is smaller than that in the conventional compressor.

The check valve can be mounted on the inlet of the muffler before the cover is mounted on the housing because the housing and the cover cooperate to form the muffler. As a result, the work of mounting the check valve becomes easy.

BEST MODE FOR CARRYING OUT THE INVENTION

Preferred embodiments of the present invention will be described.

Embodiment 1

As shown in FIG. 1, a variable displacement swash plate compressor 100 is provided with a cylinder block 101 having a plurality of cylinder bores 101*a*, a front housing 102 opposing one end of the cylinder block 101 and a rear housing 104 opposing the other end of the cylinder block 101, with a valve plate 103 inserted between them.

A driving shaft 106 extends across a crank chamber 105 formed by the cylinder block 101 and the front housing 102. The driving shaft 106 passes through a swash plate 107. The swash plate 107 is connected to a rotor 108 fixed to the driving shaft 106 through a connection member 109 to be supported by and variable in inclination relative to the driving shaft 106. A coil spring 110 is disposed between the rotor 108 and the swash plate 107 to force the swash plate 107 in the direction to the minimum inclination angle. A coil spring 111 is also provided. The coil springs 110 and 111 are disposed to face opposite surfaces of the swash plate 107. The coil spring 111 forces the swash plate 107 in the direction to the maximum inclination angle when the inclination angle of the swash plate 107 is minimum.

One end of the driving shaft 106 passes through a boss 102*a* of the front housing 102 to extend out of the front housing 102, thereby being directly connected to a car engine B through a power transmission A. No electromagnetic clutch is disposed between the driving shaft 106 and the car engine B. A seal member 112 is disposed between the driving shaft 106 and the boss 102*a*.

The driving shaft 106 is supported in the radial direction and the thrust direction by bearings 113, 114, 115 and 116.

Pistons 117 are inserted into the cylinder bores 101*a*. Each piston 117 is provided with a concave 117*a* at one end. The concave 117*a* accommodates a pair of shoes 118 for clamping the outer periphery of the swash plate 107 to be slidable relative to the outer periphery of the swash plate 107. Rotation of the driving shaft 106 is converted to reciprocal movement of the piston 117 through the swash plate 107 and the shoes 118.

The rear housing 104 forms a suction chamber 119 and a discharge chamber 120. The suction chamber 119 communicates with the cylinder bores 101*a* through communication holes 103*a* formed in the valve plate 103 and suction valves. The discharge chamber 120 communicates with the cylinder bores 101*a* through discharge valves and communication holes 103*b* formed in the valve plate 103. The suction valves and the discharge valves are not shown in FIG. 1. The suction chamber 119 communicates with the evaporator of a car air conditioner through a suction port 104*a*. The evaporator and the car air conditioner are not shown in FIG. 1.

The front housing 102, the cylinder block 101, the valve plate 103 and the rear housing 104 cooperate to form a housing for accommodating a compressing mechanism formed by the driving shaft 106, the rotor 108, the connecting member 109, the swash plate 107, the shoes 118, the pistons 117, the cylinder bores 101*a*, the suction valves, the discharge valves, etc.

A muffler 121 is disposed outside the cylinder block 101. The muffler 121 is formed by a cylindrical wall 101*b* formed on the outer surface of the cylinder block 101 and a cover 122 having a cylindrical form closed at one end, independent of the cylinder block 101 and connected to the cylindrical wall 101*b* with a seal member inserted between them. The cover 122 is a cylinder closed at one end. The sectional shapes of the cylindrical wall 101*b* and the cover 122 are not restricted to circles. A discharge port 122*a* is formed in the cover 122. The discharge port 122*a* connects to the condenser of the car air conditioner. The condenser is not shown in FIG. 1.

A communication passage 123 is formed through the cylinder block 101, the valve plate 103 and the rear housing 104 to communicate the muffler 121 with the discharge chamber 120. The muffler 121 and the communication passage 123 cooperate to form a discharge passage extending between the discharge chamber 120 and the discharge port 122*a*. The muffler 121 forms an expanded space disposed on the discharge passage.

The front housing 102, the cylinder block 101, the valve plate 103 and the rear housing 104 are disposed adjacent to each other with gaskets inserted between them and assembled as a unitary body with plurality of through bolts.

A check valve 200 for closing an inlet of the muffler 121 is disposed in the muffler 121.

As shown in FIGS. 2(*a*), 2(*b*), and 3, the check valve 200 comprises a valve body 201 of cylindrical form closed at one end, a valve seat forming member 202 having a cylindrical form and provided with an inlet hole 202*a* and a valve seat 202*b* surrounding the inlet hole 202*a* and for abutting the valve body 201, a spring 203 for forcing the valve body 201 in the direction for closing the check valve 200, and an accommodation member 204 having a cylindrical form closed at one end and fitted in and fixed to the valve seat forming member 202 to accommodate the valve body 201 and the spring 203. The accommodation member 204 is provided with plurality of outlet holes 204*a* directed at right angles to the inlet hole 202*a* and capable of being closed by the valve body 201 at the circumferential sidewall. The cross sectional shapes of the valve body 201, the valve seat forming member 202 and the accommodation member 204 are not restricted to circles. The inlet hole 202*a* opposes the muffler side end of the communicating passage 123, and the outlet holes 204*a* are spaced from each other in the circumferential direction and oppose the muffler 121.

The valve seat forming member 202 is provided with a flange 202*c*. An O-ring 205 is fitted in a circumferential groove formed in the outer circumferential surface of the flange 202*c*. Referring to FIG. 2(*b*), the check valve 200 is fixed to the cylinder block 101, with the flange 202*c* fitting in a large diameter portion of the communicating passage 123 formed at the muffler side end thereof and clamped by the cylindrical wall 101*b* of the cylinder block 101 and a presser 122*b* formed by a part of the open end of the cover 122. In FIG. 2(*b*), the presser 122*b* of the cover 122 overlaps the cylinder block 101 and the flange 202*c* to fix the check valve 200.

A small hole 204*b* is formed in the bottom wall of the accommodation member 204.

Each of the outlet holes 204*a* has a form of a combination of a triangular portion convex toward the valve seat 202*b* with one apex directed to the valve seat 202*b* and a rectangular portion with one side coinciding with the base of the triangular portion.

A displacement control valve 300 is connected to the rear housing 104. The displacement control valve 300 controls the aperture of a communication passage 124 extending between the discharge chamber 120 and the crank chamber 105 to control the flow rate of the discharging refrigerant gas led into the crank chamber 105. The refrigerant gas in the crank chamber 105 is led into the suction chamber 119 through spaces between the bearings 115, 116 and the driving shaft 106, a space 125 formed in the cylinder block 101 and an orifice hole 103*c* formed in the valve plate 103.

The displacement control valve 300 can control the internal pressure of the crank chamber 105 to control the displacement of the variable displacement swash plate compressor 100. The displacement control valve 300 controls the supply of electric current to a built-in solenoid based on an external control signal to control the displacement of the variable displacement swash plate compressor 100, thereby keeping the internal pressure of the suction chamber 119 constant. The displacement control valve 300 stops the supply of electric current to the built-in solenoid to mechanically open the communication passage 124, thereby minimizing the displacement of the variable displacement compressor 100.

Operation of the variable displacement swash plate compressor 100 will be described.

When the car engine operates and the car air conditioner does not operate, no electric current is supplied to the built-in solenoid of the displacement control valve 300, the communication passage 124 is mechanically opened, and the displacement of the variable displacement swash plate compressor 100 is kept minimum. The valve body 201 forced by the spring 203 abuts the valve seat 202*b* to close the inlet hole 202*a* and the outlet holes 204*a*. Thus, the check valve 200 closes the inlet of the muffler 200. Although the variable displacement swash plate compressor 100 directly connected to the car engine is run at the minimum displacement, refrigerant gas does not return to the car air conditioner. As a result, unnecessary air-conditioning is prevented.

Refrigerant gas discharged from the cylinder bores 101*a* to the discharge chamber 120 at the minimum flow rate circulates in an internal circulation circuit formed by the communication passage 124 extending between the discharge chamber 120 including the displacement control valve 300 and the crank chamber 105, the crank chamber 105, the spaces between the bearings 115, 116 and the driving shaft 106, the space 125, the orifice hole 103*c*, the suction chamber 119 and the communication holes 103*a*.

When the car air conditioner operates, electric current is supplied to the built-in solenoid of the displacement control valve 300 to close the communication passage 124. Internal pressure of the crank chamber 105 descends to the same level as the internal pressure of the suction chamber 119, thereby increasing the inclination angle of the swash plate 107 and the reciprocal stroke of the pistons 117. When the internal pressure of the discharge chamber 120 increases and the difference between the pressure acting on the front surface of the valve body 201 and the pressure acting on the rear surface of the valve body 201 exceeds a predetermined level, the valve body 201 separates from the valve seat 202*b* to open the inlet hole 202*a* and the outlet holes 204*a*, thereby opening the inlet of the muffler 121. The discharge chamber 120 communicates with the muffler 121 through the communication passage 123 and the check valve 200. Refrigerant gas returns to the car air conditioner through the discharge port 122*a*.

The electric current supply to the built-in solenoid of the displacement control valve 300 is appropriately controlled based on the external control signal, and the displacement of the variable displacement swash plate compressor 100 is appropriately controlled.

Reciprocal movements of the plurality of pistons 117 generate a pressure pulsation of refrigerant gas discharging to the discharge chamber 120, the basic degree thereof being equal to the number of the pistons. The pressure pulsation is damped in the muffler 121 to be transmitted to the car air conditioner. As a result, vibrations of the external refrigerant circuit extending from the discharge port 122*a* to the condenser and the condenser are prevented and noise caused by the vibrations is prevented.

In the variable displacement swash plate compressor 100, the check valve 200 is disposed in the muffler 121 so as to extend the discharge passage between the discharge chamber 120 and the discharge port 122*a* from the discharge chamber 120 directly to the muffler 121 at the portion 123 extending between the discharge chamber 120 and the muffler 121. Therefore, the length of the discharge passage extending from the discharge chamber 120 to the discharge port 122*a* becomes shorter than that in the conventional compressor wherein an accommodation chamber for accommodating the check valve is disposed on the portion of the discharge passage extending between the discharge chamber and the muffler. The space between the check valve 200 and the surrounding wall of the muffler 121 is larger than the space between the check valve and the surrounding wall of the accommodation space in the conventional compressor because the muffler 121 is an expanded space. As a result, pressure loss caused by the discharge passage extending from the discharge chamber 120 to the discharge port 122*a* in the variable displacement swash plate compressor 100 is smaller than that in the conventional compressor.

In the variable displacement swash plate compressor 100, the outlet holes 204*a* of the check valve 200 oppose the muffler 121 with large volume instead of the conventional accommodation chamber with small volume. Therefore, pressure loss of the discharge passage extending from the discharge chamber 120 to the discharge port 122*a* is smaller than that in the conventional compressor.

In the variable displacement swash plate compressor 100, the check valve 200 can be mounted on the inlet of the muffler 121 before the cover 122 is mounted on the cylinder block 101 because the cylinder block 101 and the cover 122 independent of and connected to the cylinder block 101 cooperate to form the muffler 121. As a result, the work of mounting the check valve 200 becomes easy.

In the variable displacement swash plate compressor 100, the cover 122 and the cylinder block 101 cooperate to clamp the check valve 200, thereby fixing it to the cylinder block 101. Therefore, the connection structure between the check valve 200 and the cylinder block 101 becomes simpler than that achieved by a snap ring, press fitting, etc.

The valve body 201 of the check valve 200 sometimes self-excitedly vibrates to cause noise. In the variable displacement swash plate compressor 100, the small hole 204*b* formed in the bottom wall of the accommodation member 204 restricts the flow rate of refrigerant gas entering into or discharging from a space 206 formed between the valve body 201 and the bottom wall of the accommodation member 204 through the small hole 204*b* to a very low level, thereby forming a damper for preventing self-excited vibration of the valve body 201 and pulsation of discharge pressure caused by the self-excited vibration of the valve body 201.

When the variable displacement swash plate compressor 100 is run at a small displacement, the valve body 201 lifts a little when the check valve 200 opens because the pressure acting on the front surface of the valve body 201 differs only a little from the pressure acting on the rear surface of the valve body 201.

If the outlet holes 204*a* are rectangular, the opening area of the outlet holes 204*a* becomes fairly large when the check valve 200 opens even though the lift of the valve body 201 is small. Thus, refrigerant gas discharges form the outlet holes 204*a* at fairly large flow rate to rapidly decrease the difference between the pressure acting on the front surface of the valve body 201 and the rear surface of the valve body 201, thereby rapidly closing the check valve 200. When the check valve 200 closes, the difference between the pressure acting on the front surface of the valve body 201 and the rear surface of the valve body 201 rapidly increases to rapidly open the check valve 200. As a result, the check valve 200 repeatedly opens and closes when the variable displacement swash plate compressor 100 is run at a small displacement to cause self-excited vibration of the valve body 201, thereby generating pulsation of discharge pressure.

In the variable displacement swash plate compressor 100, each of the outlet holes 204*a* has a form of a combination of a triangular portion convex toward the valve seat 202*b* with one apex directed to the valve seat 202*b* and a rectangular portion with one side coinciding with the base of the triangular portion. Therefore, the opened portion of the outlet hole 204*a* becomes triangular and the opening area of the outlet hole 204*a* does not become large and the flow rate of the refrigerant gas discharging from the outlet hole 204*a* does not become large when the lift of the valve body 201 is small. As a result, rapid decrease of the difference between the pressure acting on the front surface of the valve body 201 and the rear surface of the valve body 201 is prevented, generation of self-exciting vibration of the valve body 201 is prevented, and generation of pulsation of the discharge pressure is prevented when the variable displacement swash plate compressor 100 is run at small displacement.

Embodiment 2

As shown in FIG. 4, a muffler 121' can be disposed outside the rear housing 104 instead of disposing the muffler 121 outside the cylinder block 101. The muffler 121' is formed by a cylindrical wall 104*b* formed on the outer surface of the rear housing 104 and a cover 122' having a cylindrical form closed at one end, independent of the rear housing 104 and connected to the cylindrical wall 104*b* with a seal member inserted between them. A discharge port 122*a*' is formed in the cover 122'. The rear housing 104 is provided with an opening 104*c* at the bottom wall forming a part of the surrounding wall of the discharge chamber 120. The discharge chamber 120 communicates with the muffler 121' through the opening 104*c*. The opening 104*c* forms an inlet of the muffler 121'.

The check valve 200 is disposed in the muffler 121' and pressed in the opening 104*c* at the flange 202*c* to be fixed to the rear housing 104. The inlet hole 202*a* of the check valve 200 opposes the opening 104*c* and the outlet holes 204*a* oppose the muffler 121'.

The structure shown in FIG. 4 achieves the same effects as those achieved by the structure shown in FIGS. 1 to 3.

Embodiment 3

The present invention can be applied to various kinds of piston compressors other than variable displacement swash plate compressor, such as variable displacement wobble plate compressors, fixed displacement swash plate compressors, fixed displacement wobble plate compressors, etc.

The present invention can be applied to various kinds of piston compressors connected to external power sources through clutches.

The present invention can be applied to various kinds of piston compressors driven by external motors.

CO2 or R152a can be used as refrigerant gas instead of R134a widely used nowadays.

Industrial Applicability

The present invention can be applied to various kinds of piston compressors.

BRIEF DESCRIPTION OF THE DRAWINGS

FIG. 3(*a*) shows the check valve in open condition and FIG. 3(*b*) shows the check valve in closed condition. In the figures, the left halves show side views and the right halves show cross sectional views.

Figure 1:
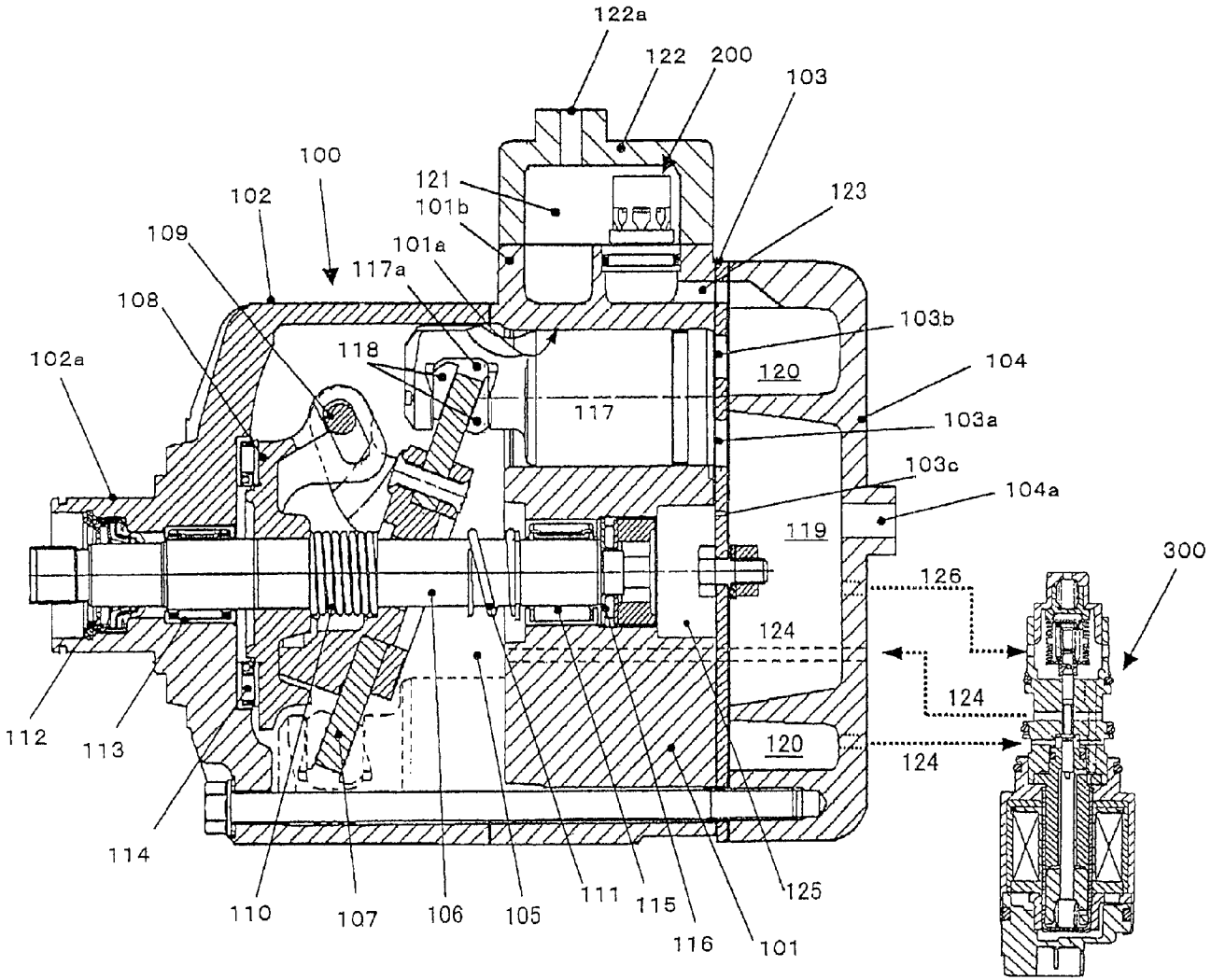
FIG. 1 is a sectional view of a variable displacement swash plate compressor in accordance with a first preferred embodiment of the present invention.
Figure 2:
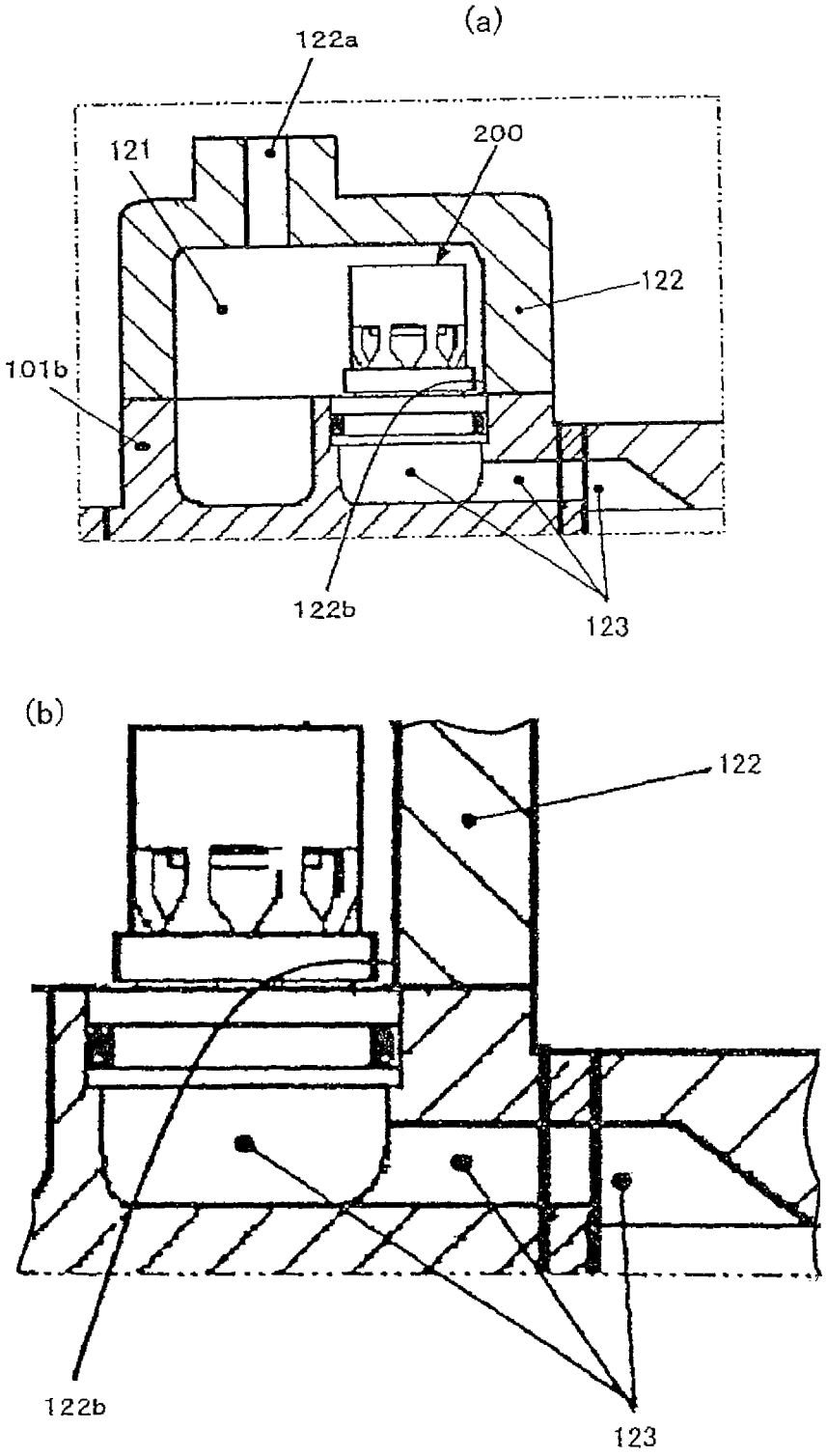
FIG. 2(*a*) is a partially enlarged view of FIG. 1, and FIG. 2(*b*) is an partially enlarged view of FIG. 2(*a*).
Figure 3:
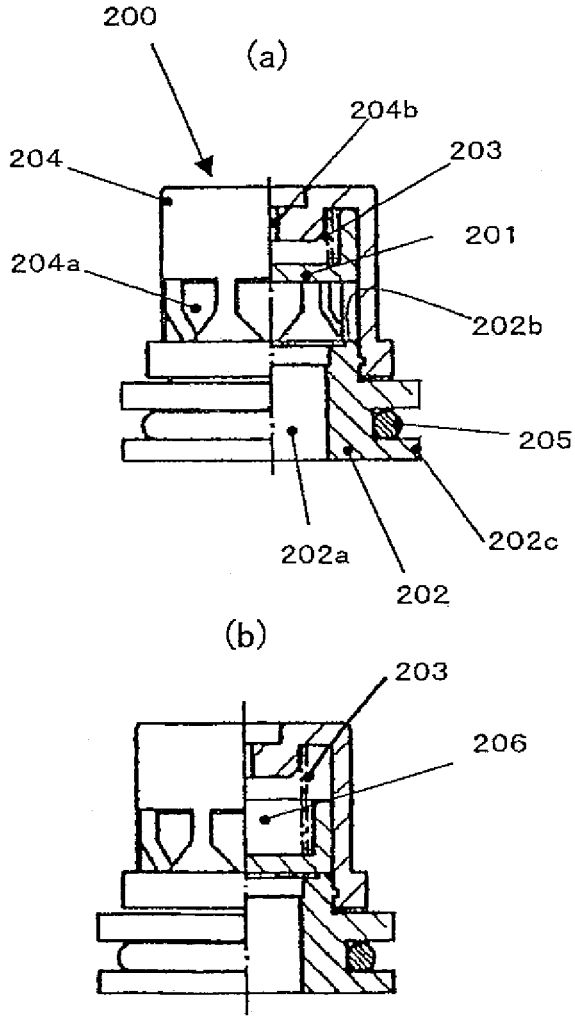
FIG. 3 is a structural view of a check valve installed in the variable displacement swash plate compressor in accordance with the first preferred embodiment of the present invention.
Figure 4:
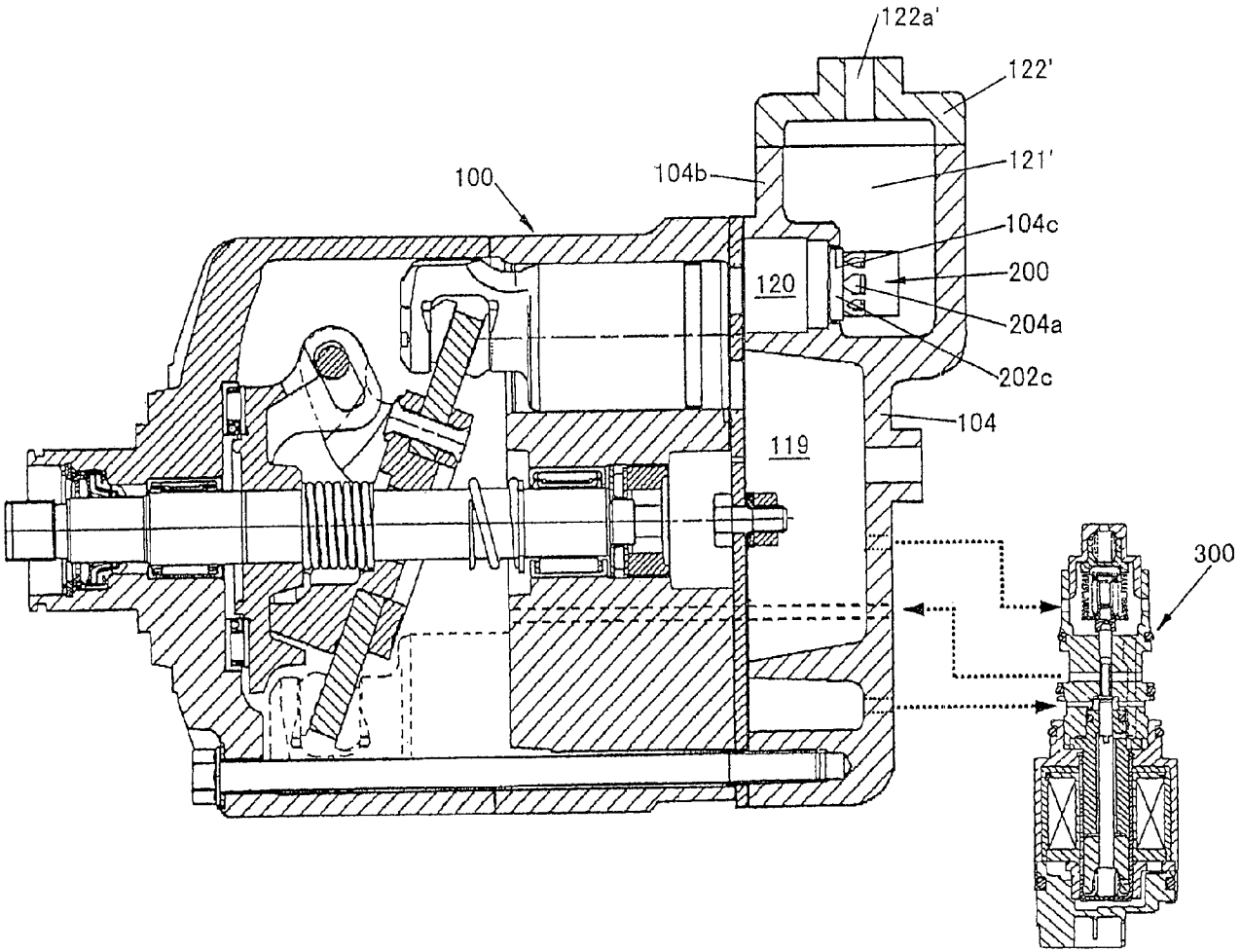
FIG. 4 is a sectional view of a variable displacement swash plate compressor in accordance with a second preferred embodiment of the present invention.

An object of the present invention is to provide a compressor comprising a compressing mechanism, a discharge chamber, a housing accommodating the compressing mechanism and the discharge chamber, a discharge port communicating with the discharge chamber through a discharge passage and also with an external refrigerant circuit, a muffler formed by an expanded space disposed on the discharge passage, and a check valve disposed on the discharge passage. The pressure loss caused by the discharge passage in such a compressor is less than that in the conventional compressor.

A compressor comprises a compressing mechanism, a discharge chamber, a housing accommodating the compressing mechanism and the discharge chamber, a discharge port communicating with the discharge chamber through a discharge passage and an external refrigerant circuit, a muffler formed by an expanded space disposed on the discharge passage, and a check valve disposed on the discharge passage. The check valve is disposed in the muffler to open and close an inlet of the muffler, and the muffler is formed by the housing and a cover independent of and connected to the housing.

The invention claimed is:

1. A compressor comprising:

a compressing mechanism, a discharge chamber configured to receive compressed refrigerant from the compressing mechanism, a housing accommodating the compressing mechanism and the discharge chamber, a discharge port communicating with the discharge chamber through a discharge passage and an external refrigerant circuit, a muffler formed by an expanded space disposed on the discharge passage, and a check valve disposed on the discharge passage, wherein the check valve is disposed in the muffler to open and close an inlet of the muffler, and the muffler is formed by cooperation of the housing and a cover independent of and connected to the housing, wherein the check valve comprises outlet holes formed therein, the outlet holes being open toward the muffler, and the check valve and the cover are disposed such that an end of the check valve, which is on an outlet holes side of the check valve and faces the cover, and the cover form a predetermined spacing therebetween, wherein the discharge passage receives the compressed refrigerant from the discharge chamber, wherein the expanded space forming the muffler receives the compressed refrigerant from the discharge passage after the refrigerant has passed through the outlet holes formed in the check valve, and wherein the discharge port receives the compressed refrigerant from the expanded space forming the muffler and discharges the compressed refrigerant to the external refrigeration circuit.

2. The compressor of claim 1, wherein the check valve comprises a valve body, a valve seat forming member provided with an inlet hole and a valve seat surrounding the inlet hole and for abutting the valve body, a spring for forcing the valve body a direction for closing the check valve, and an accommodation member having a cylindrical form closed at one end and fixed to the valve seat forming member to accommodate the valve body and the spring, wherein the accommodation member is provided with the outlet holes directed at right angles to the inlet hole and configured to be closed by the valve body at a circumferential side wall of the valve body, and the inlet hole opposes a muffler side end of a portion of the discharge passage extending between the discharge chamber and the muffler, and the outlet holes oppose the muffler.

3. The compressor of claim 2, wherein the accommodation member is provided with a small hole at a bottom wall of the accommodation member.

4. The compressor of claim 2, wherein the displacement of the compressor is variable, and each of the outlet holes has a form of a combination of a triangular portion convex toward the valve seat with one apex directed to the valve seat and a rectangular portion with one side coinciding with the base of the triangular portion.

5. The compressor of claim 1, wherein the compressing mechanism is a variable displacement swash plate compressing mechanism or a variable displacement wobble plate compressing mechanism, and a driving shaft of the compressing mechanism is connected to an external power source without an intervening clutch.

6. The compressor of claim 3, wherein the displacement of the compressor is variable, and each of the outlet holes has a form of a combination of a triangular portion convex toward the valve seat with one apex directed to the valve seat and a rectangular portion with one side coinciding with the base of the triangular portion.

7. The compressor of claim 2, wherein the compressing mechanism is a variable displacement swash plate compressing mechanism or a variable displacement wobble plate compressing mechanism, and a driving shaft of the compressing mechanism is connected directly to an external power source without an intervening clutch.

8. The compressor of claim 3, wherein the compressing mechanism is a variable displacement swash plate compressing mechanism or a variable displacement wobble plate compressing mechanism, and a driving shaft of the compressing mechanism is connected directly to an external power source without an intervening clutch.

9. The compressor of claim 4, wherein the compressing mechanism is a variable displacement swash plate compressing mechanism or a variable displacement wobble plate compressing mechanism, and a driving shaft of the compressing mechanism is connected directly to an external power source without an intervening clutch.

10. The compressor of claim 6, wherein the compressing mechanism is a variable displacement swash plate compressing mechanism or a variable displacement wobble plate compressing mechanism, and a driving shaft of the compressing mechanism is connected directly to an external power source without an intervening clutch.

* * * * *